US006929121B2

(12) United States Patent
Boriani et al.

(10) Patent No.: US 6,929,121 B2
(45) Date of Patent: Aug. 16, 2005

(54) BLANK FOR RIGID HINGE-LID TYPE WRAPPERS FOR TOBACCO PRODUCTS AND A PROCEDURE FOR MANUFACTURING SUCH WRAPPERS

(75) Inventors: Silvano Boriani, Bologna (IT); Roberto Polloni, Modigliana (IT); Fiorenzo Draghetti, Medicina (IT)

(73) Assignee: G.D. S.p.A., Bologna (IT)

( * ) Notice: Subject to any disclaimer, the term of this patent is extended or adjusted under 35 U.S.C. 154(b) by 228 days.

(21) Appl. No.: 10/450,784

(22) PCT Filed: Dec. 18, 2001

(86) PCT No.: PCT/IB01/02630

§ 371 (c)(1),
(2), (4) Date: Jun. 18, 2003

(87) PCT Pub. No.: WO02/051719

PCT Pub. Date: Jul. 4, 2002

(65) Prior Publication Data

US 2004/0050726 A1 Mar. 18, 2004

(30) Foreign Application Priority Data

Dec. 22, 2000 (IT) ..... BO2000A0741

(51) Int. Cl.[7] ..... A24F 15/00
(52) U.S. Cl. ..... 206/273; 206/268; 229/87.13
(58) Field of Search ..... 206/242, 259, 206/261, 262, 263, 265, 268, 271, 273, 274; 229/87.01, 87.13

(56) References Cited

U.S. PATENT DOCUMENTS

| | | | | |
|---|---|---|---|---|
| 1,940,849 A | * | 12/1933 | Davidson | 229/223 |
| 2,369,391 A | * | 2/1945 | Ringler | 229/145 |
| 2,617,578 A | * | 11/1952 | Fischer | 206/214 |
| 2,963,213 A | | 12/1960 | Nauman | |
| 4,447,003 A | * | 5/1984 | Gray | 229/146 |
| 5,036,982 A | | 8/1991 | Aston | |
| 5,161,733 A | * | 11/1992 | Latif | 229/225 |
| 5,586,648 A | * | 12/1996 | Focke et al. | 206/264 |
| 6,138,823 A | * | 10/2000 | Focke et al. | 206/259 |
| 6,199,688 B1 | | 3/2001 | Focke | |

FOREIGN PATENT DOCUMENTS

| | | |
|---|---|---|
| DE | 77 20 179 | 11/1977 |
| DE | 196 36 365 | 4/1998 |
| DE | 199 12 995 | 9/2000 |
| WO | 00/05151 | 2/2000 |
| WO | 00/43289 | 7/2000 |

* cited by examiner

*Primary Examiner*—John A. Ricci
(74) *Attorney, Agent, or Firm*—Harbin King & Klima

(57) ABSTRACT

A rigid type wrapper (1) with a hinged lid (13) is fashioned from a flat diecut blank (42) presenting a treated face and an untreated face and comprising a main portion (45) destined to form the container (11) and the lid (13) of the wrapper (1), also an appendage (50), destined to provide a stiffening frame (23), appearing as a first portion (51) and two connecting arms (52) terminating at the opposite ends in first and second precreased fold lines (53, 54) along which the arms (52) are hinged respectively to the main portion (45) and to the first portion (51) of the blank. The frame (23) is erected by rotating the arms (52) about the respective first precreased fold line (53) to the point at which they are bent double over the main portion (45), and simultaneously rotating the first portion (51) of the appendage (50) about the respective second precreased fold lines (54) to the point at which the treated face of the first portion (51) is bent double over the untreated face of the main portion (45), so that when the wrapper (1) is fully assembled, the frame (23) will be positioned with the treated surface facing outwards.

19 Claims, 10 Drawing Sheets

BLANK FOR RIGID HINGE-LID TYPE WRAPPERS FOR TOBACCO PRODUCTS AND A PROCEDURE FOR MANUFACTURING SUCH WRAPPERS

This application is the national phase of International Application PCT/IB01/02630 filed on Dec. 18, 2001 which designated the United States, and that International Application was published under PCT article 21(2) in English.

TECHNICAL FIELD

The present invention relates to a diecut blank from which to fashion wrappers of rigid type with a hinged lid for tobacco products.

The term "rigid wrapper" as used in the following specification can be taken to mean either a carton proportioned to accommodate a plurality of packets of cigarettes, or a single packet containing a group of cigarettes or tobacco products broadly considered.

BACKGROUND ART

In general, rigid wrappers of the type in question with a hinged lid are box-like, presenting the shape of a rectangular parallelepiped, and designed to hold a plurality of packets of cigarettes, in the case of a carton, or an ordered group of cigarettes enveloped in an inner wrapper normally of metal foil paper, in the case of a packet of cigarettes.

The rigid wrapper comprises a container, also a lid hinged to a rear edge of the container and rotatable thus between positions in which the container is open and closed, respectively. Normally, the rigid wrapper comprises a top end face, a bottom end face, a rear face consisting in a continuous panel divided into two parts by a transverse hinge line along which the lid and the container are joined, a front face comprising two distinct portions constituting the front face of the container and the front face of the lid, respectively, and two flank faces each comprising two distinct portions constituting the flank face of the container and the flank face of the lid, respectively.

The container and lid are fashioned generally by folding a single diecut blank of cardboard or similar material. One side of the blank, constituting the external face of the wrapper that will be exposed to view, has a treated surface bearing written and decorative matter, whilst the other side constituting the internal face of the wrapper, concealed from view, is left untreated.

Rigid wrappers of the type described above are furnished normally with a stiffening frame, also of cardboard or similar material, positioned partially inside the container and breasted in contact with the inner surface of the front face and the flank faces of the selfsame container. The part of the frame that projects from the container functions essentially as an element against which the lid locates and is held stable when occupying the closed position.

The prior art embraces procedures for manufacturing wrappers of the type described above in which the groups of cigarettes, enveloped in their respective inner wrappers, are paired with frames cut from a continuous strip of paperboard separately from the blank constituting the rigid wrapper; the prior art also embraces procedures involving the use of flat diecut blanks with the frame already incorporated.

In the latter instance, more particularly, it is the practice to use a flat blank of which a central panel, coinciding with the front face of the rigid wrapper fashioned from the blank, is associated along one endmost edge with a stiffening frame, by way of an intermediate panel.

In a second type of blank incorporating a frame, the frame is connected to the edges of two lateral panels coinciding with the flanks of the rigid wrapper. When the wrapper is erected, the frame prepared in this way will be bent double into overlapping contact to the inside face of the front panel, and secured in position.

In both cases, the result of the bending operation is that the untreated face of the frame is brought into contact with the untreated face of the panels destined to form the front and flank faces of the wrapper, so that when the packet is opened, the portion of the frame projecting from the container and exposed to view will present its untreated face, which conversely is not the case when using frames cut separately from a continuous strip of paperboard and paired with the group of cigarettes.

As regards the use of a blank with the frame already incorporated, the solution described betrays a drawback in terms of appearance, and moreover, prevents a smooth sliding action of the lid when opened and closed by reason of the contact between the two untreated surfaces of the lid and the frame.

The object of the present invention is to provide a wrapper of rigid type with a hinged lid for cartons and for packets of cigarettes, such as will be lo unaffected by the drawbacks mentioned above.

DISCLOSURE OF THE INVENTION

The stated object is realized according to the present invention in a blank for a wrapper of rigid type with a hinged lid for tobacco products, the wrapper appearing substantially parallelepiped in shape, presenting a front face, a rear face, two flank faces, a top end face and a bottom end face, and comprising a container and a lid joined together along a hinge line, also a frame with a U-profiled top edge, the blank presenting a transverse axis and a longitudinal axis and comprising a main portion destined to form the container and the lid, and an appendage destined to form the frame, characterized in that the appendage presents a first portion comprising the frame, and at least one connecting arm terminating at the opposite ends in first and second precreased fold lines along which the selfsame arm is joined respectively to the main portion and to the first portion comprising the frame.

The invention also relates to a procedure for the manufacture of rigid hinge-lid wrappers for tobacco products.

A procedure according to the present invention for manufacturing a wrapper of rigid type with a hinged lid for tobacco products, wherein the wrapper is obtained from a flat diecut blank presenting a transverse axis, a longitudinal axis, a treated face and an untreated face, and comprising a main portion destined to form the container and the lid and an appendage destined to form a frame, is characterized in that the appendage presents a first portion comprising the frame and at least one connecting arm terminating at the opposite ends in first and a second precreased fold lines along which the selfsame arm is joined respectively to the main portion and to the first portion comprising the frame, and in that it comprises the steps of rotating the arm about the first precreased fold line to the point at which it is bent double over the main portion, and rotating the first portion of the appendage comprising the frame about the second precreased fold line to the point at which the treated face of the selfsame first portion is bent double over the untreated face of the main portion.

BRIEF DESCRIPTION OF THE DRAWINGS

The invention will now be described in detail, by way of example, with the aid of the accompanying drawings, in which.

DETAILED DESCRIPTION OF THE INVENTION

Figure 1:
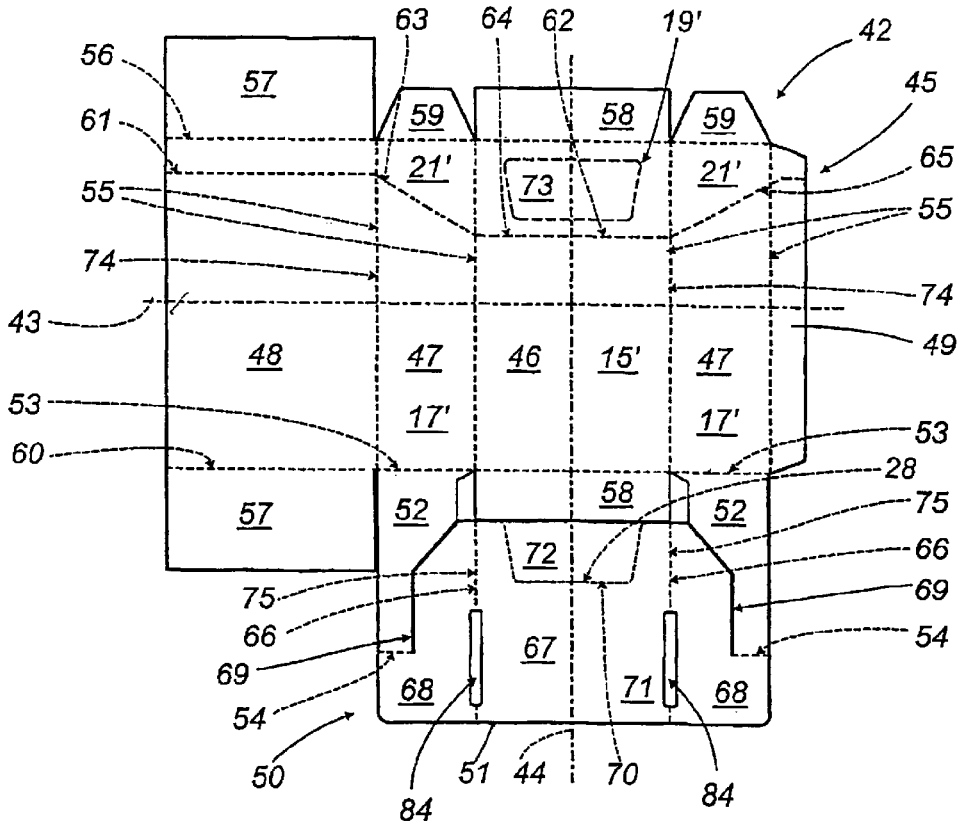
FIGS. 1 to 4 illustrate four flat diecut blanks embodied in accordance with the present invention.

With reference to FIGS. 9, 10, 11 and 12 of the drawings, 1 denotes a wrapper of rigid type with a hinged lid presenting the shape of a substantially rectangular parallelepiped with a predominating longitudinal axis 2, embodied in the particular examples of FIGS. 9, 10, 11 and 12 as a carton 3 designed to accommodate several packets 4 of cigarettes arranged as a group in two rows F each composed of five packets 4.

In each case, the single wrapper 1 presents a front face 5, a rear face 6, two flank faces 7, a top end face 8 and a bottom end face 9. Observing the wrapper of FIG. 9, in particular, the front face 5, the rear face 6 and the two flank faces 7 are joined one to the next along relative sharp corner edges 10 extending parallel to the longitudinal axis 2.

The wrapper 1 comprises a container 11 presenting an open top end 12, and uppermost, a lid 13 joined to the container along a hinge line 14 and rotatable thus between an open position (not illustrated) and a position in which the top end 12 is closed (illustrated in FIGS. 9, 10, 11 and 12).

More exactly, the container 11 presents a front 15 and a back 16, mutually opposed and parallel, two flanks 17 disposed parallel one with another and perpendicular to the front 15 and the back 16, and a bottom 18 coinciding with the bottom end face 9 of the wrapper 1.

Similarly, the lid 13 presents a front 19 and a back 20, two flanks 21, and a top 22 coinciding with the top end face 8 of the wrapper 1.

The two fronts 15 and 19 combine to establish the front face 5 of the wrapper 1, the two backs 16 and 20 combine to establish the rear face 6 of the wrapper 1, and the pairs of flanks 17 and 21 combine to establish the respective flank faces 7 of the wrapper 1.

Finally, the rigid wrapper 1 comprises a stiffening frame 23 anchored to the container 11, presenting a part 24 positioned inside the selfsame container 11, and a remaining part 25 that projects from the container through the open top 12 and functions essentially as an element against which the lid 13 locates, and by which it is held stable when occupying the closed position.

The frame 23 comprises a central portion 26 of which the part nearer to the bottom end face 9 of the wrapper 1 presents a bottom edge 27 directed toward and extending parallel with the selfsame bottom end face 9, and the part nearer the lid 13 presents a top edge 28 exhibiting a substantially U-shaped profile, appearing as a central cutaway 29 and two lateral restraints 30 extending upward toward the lid 13. The central portion 26 is fixed to the front 15 of the container 11, on the inside, in such a way that the restraints 30 and the central cutaway 29 project from the container, and is integral with two lateral portions 31 of the frame 23 fixed to the flanks 17 of the container 11, on the inside.

The lateral portions 31 are L-shaped, presenting a top end 32 that projects toward the lid 13 from the respective flank 17, and a bottom end 33 of which the transverse dimension is greater than that of the top end 32. The bottom end 33 is hinged along a top edge, denoted 34 and directed toward the lid 13, with the top end of a respective vertical panel 35 of which the remaining bottom end is hinged to the flank 17 of the container 11 along a line occupying the same plane as the bottom end face 9.

It will be noted that the central cutaway 29, the restraints 30 and the top ends 32 of the lateral portions 31 constitute the parts of the frame 23 exposed to view when the lid 13 is opened.

Figure 9:
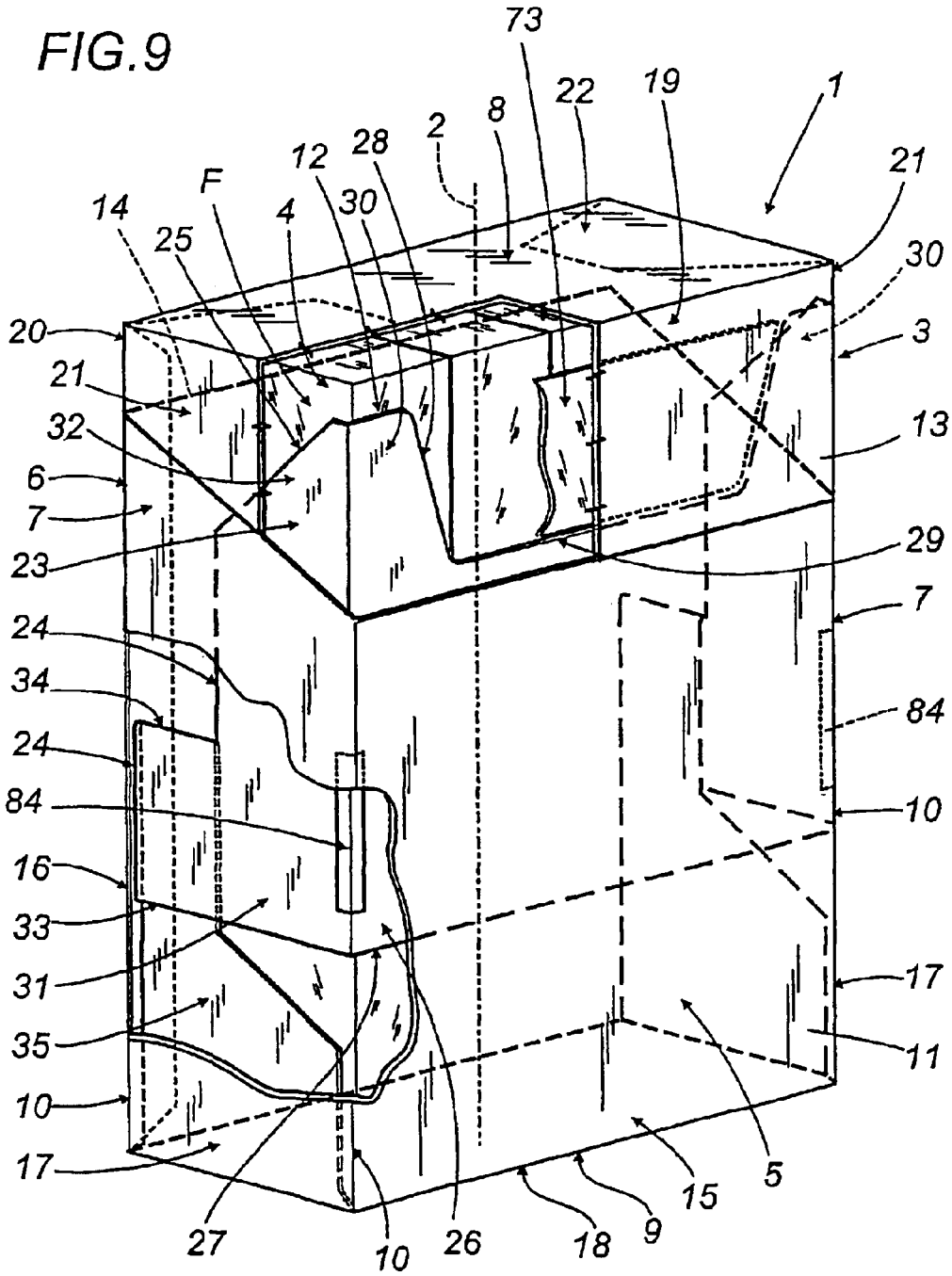
FIGS. 9 to 12 illustrate four embodiments of a rigid wrapper according to the invention, viewed schematically and in perspective, obtained from the respective blanks of FIGS. 1 to 4.
Figure 10:
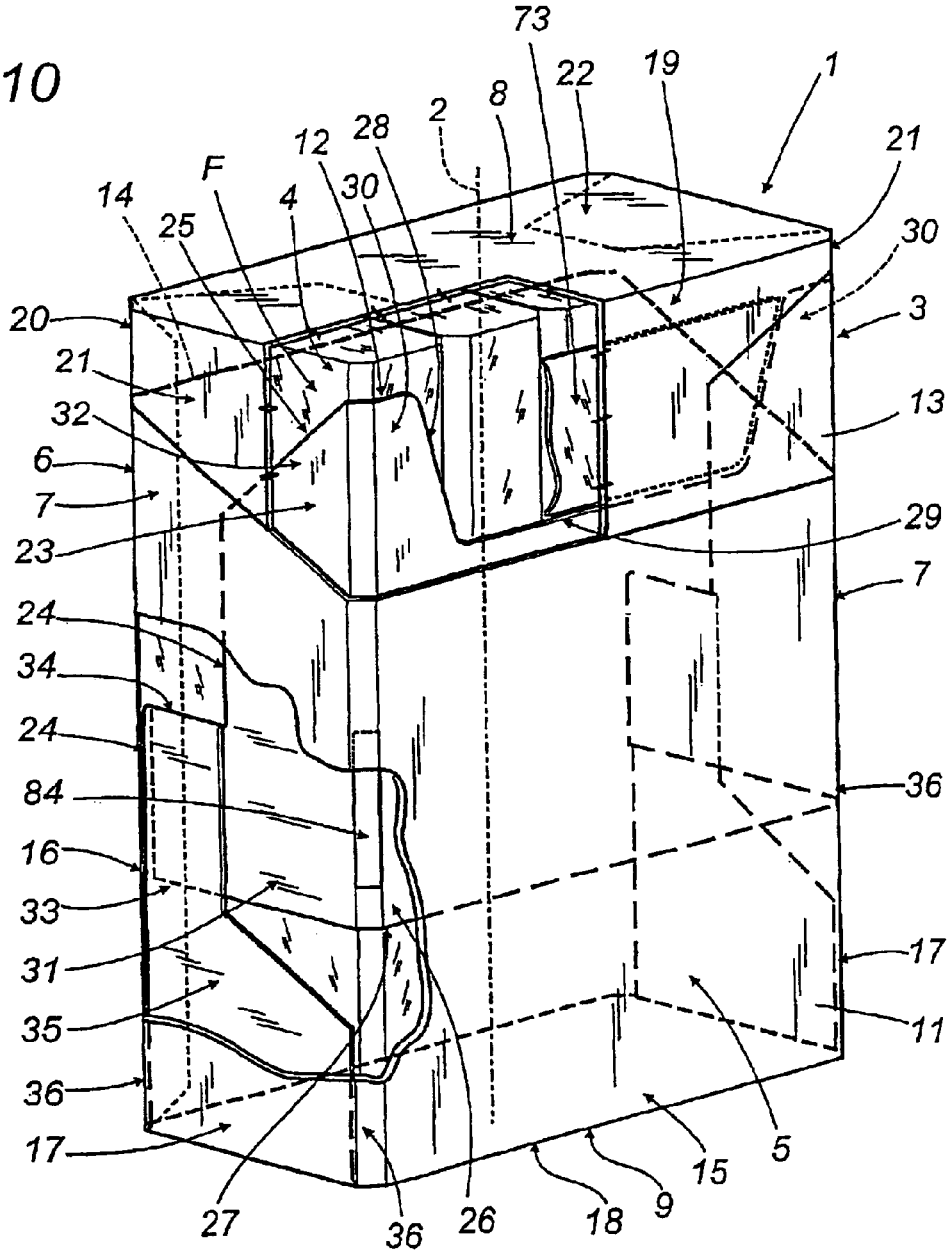
Figure 11:
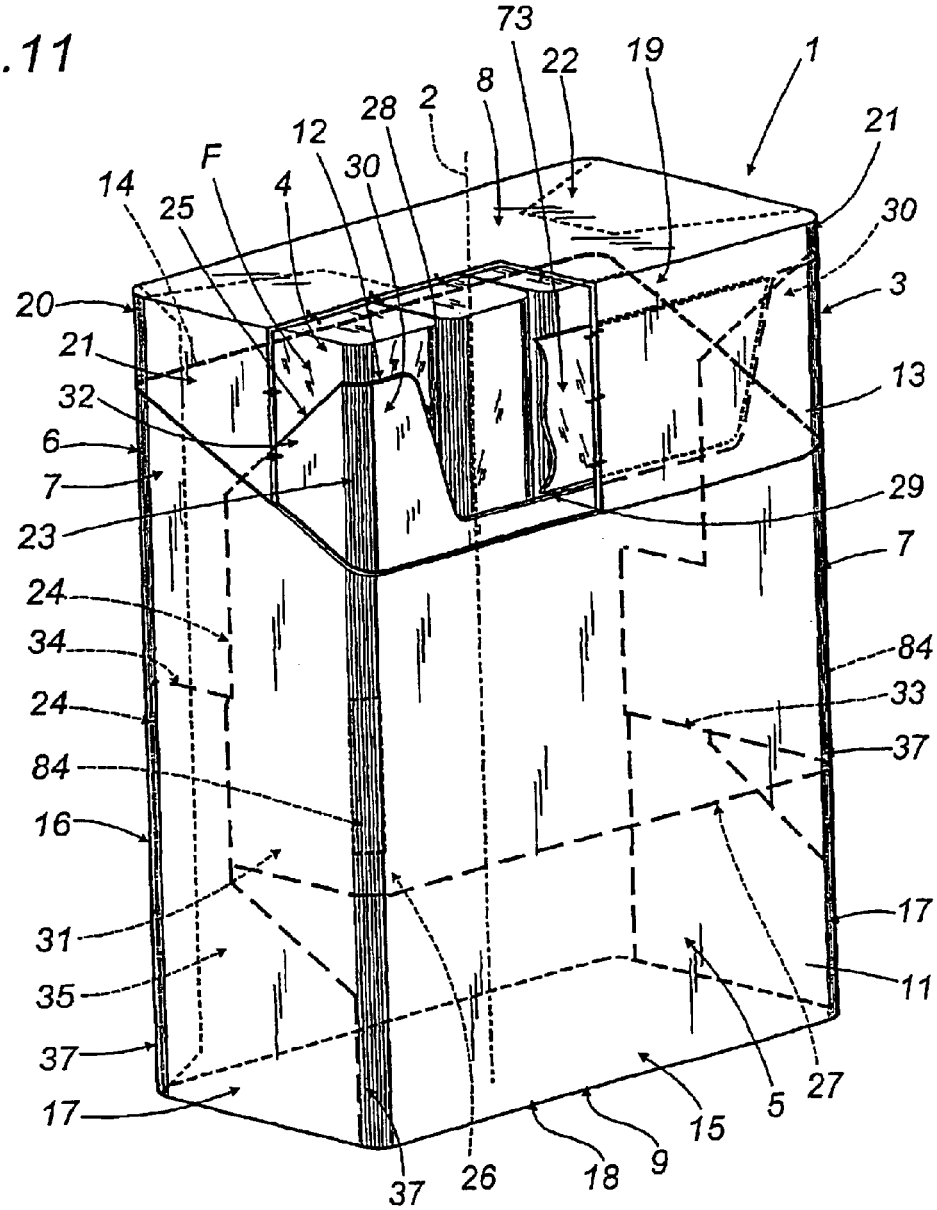

Whilst in the example of FIG. 9, the front, rear and flank faces 5, 6 and 7 of the wrapper 1 are joined one to another along sharp corner edges 10 and the carton 3 of FIG. 9 is designed to accommodate packets 4 with sharp corner edges, the corresponding faces 5, 6 and 7 of the wrapper 1 in FIG. 10 are joined along bevelled longitudinal corner edges 36 and the relative carton 3 is designed to accommodated packets 4 with bevelled corner edges, whereas the faces 5, 6 and 7 of the wrapper 1 in FIG. 11 are joined along rounded longitudinal corner edges 37 and the relative carton 3 is designed to accommodated packets 4 with rounded corner edges.

Figure 12:
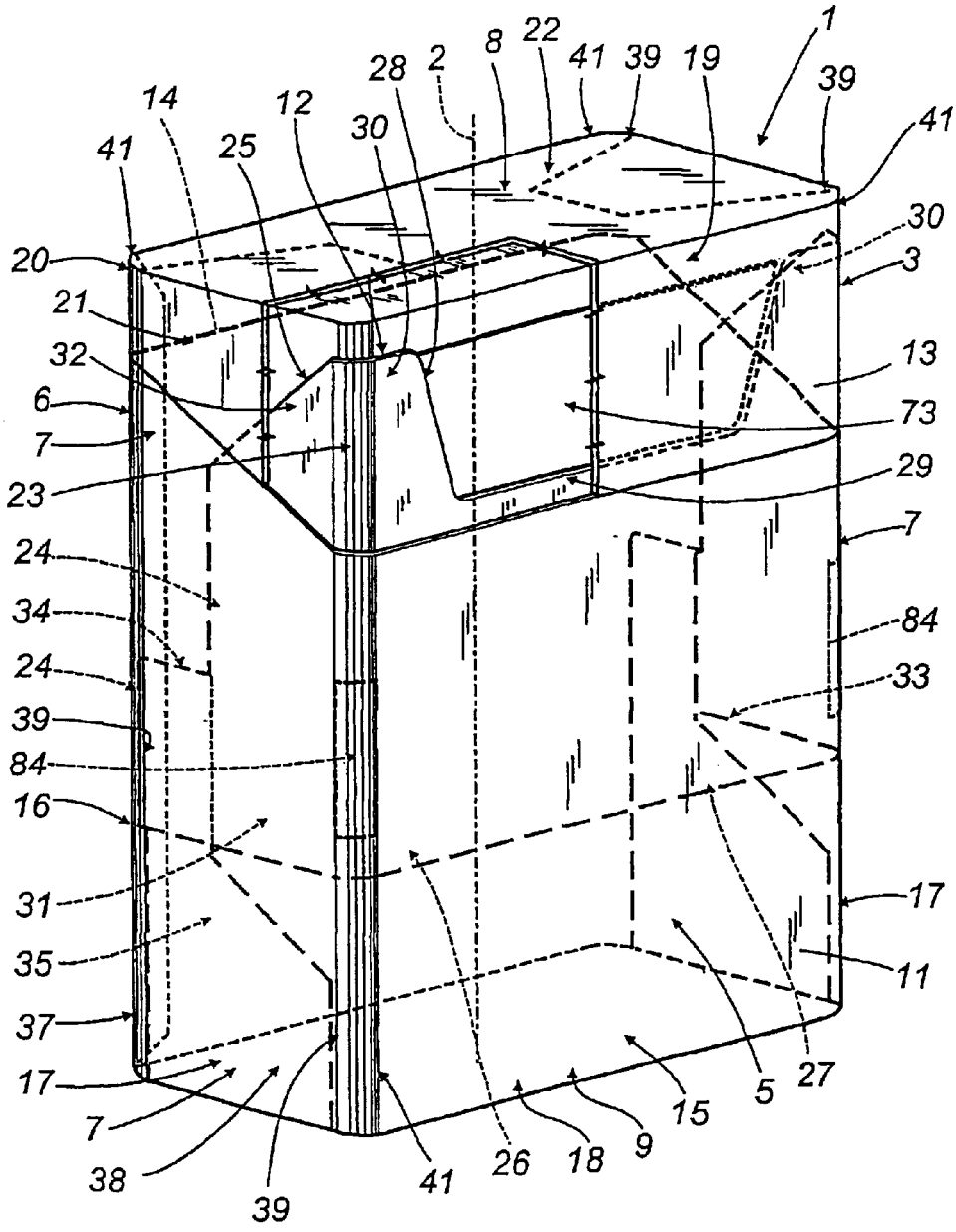

Finally, in the example of FIG. 12, the flank faces 7 of the wrapper 1 appear mutually parallel and convexly profiled, and substantially perpendicular to the front and rear faces 5 and 6. Each flank face 7 presents a flat central part 38 and two longitudinal lateral bands 39 rendered pliable internally by a plurality of crease lines 40, and joined to the respective front face 5 and rear face 6 along sharp corner edges 41.

In particular, the carton 3 of FIG. 12 is designed to accommodate packets 4 presenting similar characteristics, of the type disclosed in patent application PCT/IT99/00222, to which reference may be made for a full description.

Referring to FIGS. 1, 2, 3 and 4, the wrapper 1 is fashioned from a flat diecut blank 42 of substantially L-shaped outline referable to a transverse axis 43, and to a longitudinal axis 44 extending parallel to the axis 2 of the wrapper 1. Each of the blanks 42 comprises a main portion 45 destined to provide the container 11 and the lid 13, which is centred on the transverse axis 43 and comprises, aligned along the selfsame axis 43, a central panel 46, two lateral panels 47 disposed on either side of the central panel 46, an end panel 48 connected indirectly to the central panel 46 by way of one of the lateral panels 47, and an end flap 49 connected to the other lateral panel 47. The blank 42 further comprises an appendage 50 connected to the main portion 45 and aligned with the central panel 46 along the longitudinal axis 44. The appendage 50 comprises a first portion 51 destined to provide the frame 23, and two connecting arms 52 disposed one on either side of the first portion 51, coinciding with the aforementioned vertical panels 35, of which the opposite ends are joined respectively along first precreased fold lines 53 to the lateral panels 47 and along second precreased fold lines 54 to the first portion 51. The first and second precreased fold lines 53 and 54 are aligned in pairs, all parallel with the transverse axis 43.

The main portion 45 presents four first longitudinal precreased bend areas 55 extending perpendicular to the transverse axis 43 and defining the central panel 46, which coincides with the front face 5 of the wrapper 1, the lateral panels 47, which coincide with the flank faces 7 of the wrapper 1, the end panel 48, coinciding with the rear face 6 of the wrapper 1, and the end flap 49. The main portion 45 further comprises a first crease line 56 extending parallel to the transverse axis 43 and defining a first end fold 57 associated with the end panel 48, also a second end fold 58 associated with the central panel 46, and two flaps 59 associated each with a respective lateral panel 47. The second end fold 58 and the flaps 59 will be offered and fixed to the inside of the first end fold 57, with which they combine to make up the top end face 8 of the wrapper. A second crease line 60 extending parallel to the transverse axis 43 defines another first end fold 57 associated with the end panel 48 and another second end fold 58 associated with the central panel 46. The parts of the second crease line 60 coinciding with the lateral panels 47 are one and the same as the first precreased fold lines 53 lo mentioned previously.

The main portion 45 also comprises a crease line 61 extending across the end panel 48, parallel to the transverse axis 43, functioning as the hinge 14 along which the lid 13 is joined to the container 11, and a perforation line 62 extending across the lateral panels 47 and the central panel 46. The perforation line 62, which extends from the end of the crease line 61, comprises a first leg 63 angled toward the appendage 50 and crossing one lateral panel 47, a second leg 64 extending parallel to the transverse axis 43 and crossing the central panel 46, and a third leg 65 disposed symmetrically with the first leg 63, angled away from the appendage 50 and crossing the other lateral panel 47. The lateral panels 47 are divided by the first and third legs 63 and 65 into two respective portions denoted 17' and 21', destined to provide the flanks 17 and 21 of the container 11 and the lid 13 respectively, whilst the central panel 46 is divided by the second leg 64 into two portions denoted 15' and 19' destined to provide the front 15 of the container 11 and the front 19 of the lid 13.

The appendage 50 presents two second longitudinal precreased bend areas 66 aligned on the two first longitudinal precreased bend areas 55 bordering the central panel 46 of the main portion 45, by which the first portion 51 of the appendage 50 is divided into a central portion 67 and two lateral portions 68.

The lateral portions 68, which will become the flanks of the frame 23, appear L-shaped and are generated by respective cuts 69 separating them from the aforementioned arms 52. The cuts 69 terminate at the bottom end in alignment with the aforementioned second precreased fold lines 54 along which the lateral portions 68 are joined to the arms 52.

The central portion 67 is divided by a perforation line 70 defining the U-profiled top edge 28 of the frame 23, into a first area 71 constituting the breast piece of the frame 23, and a second area 72 providing a cutout 73 that will be applied to the inside of the portion 19' of the central panel 46 coinciding with the front 19 of the lid 13, so as to function as a stiffening element for the lid 13.

With reference to FIG. 1, the blank 42 is used to fashion a wrapper 1 as illustrated in FIG. 9 and the precreased bend areas 55 consist in single crease lines 74 generating sharp corner edges 10 on the erected wrapper 1.

Similarly, the second precreased bend areas 66 consist in crease lines 75 generating a frame 23 with sharp corner edges when the wrapper is erected.

Figure 2:
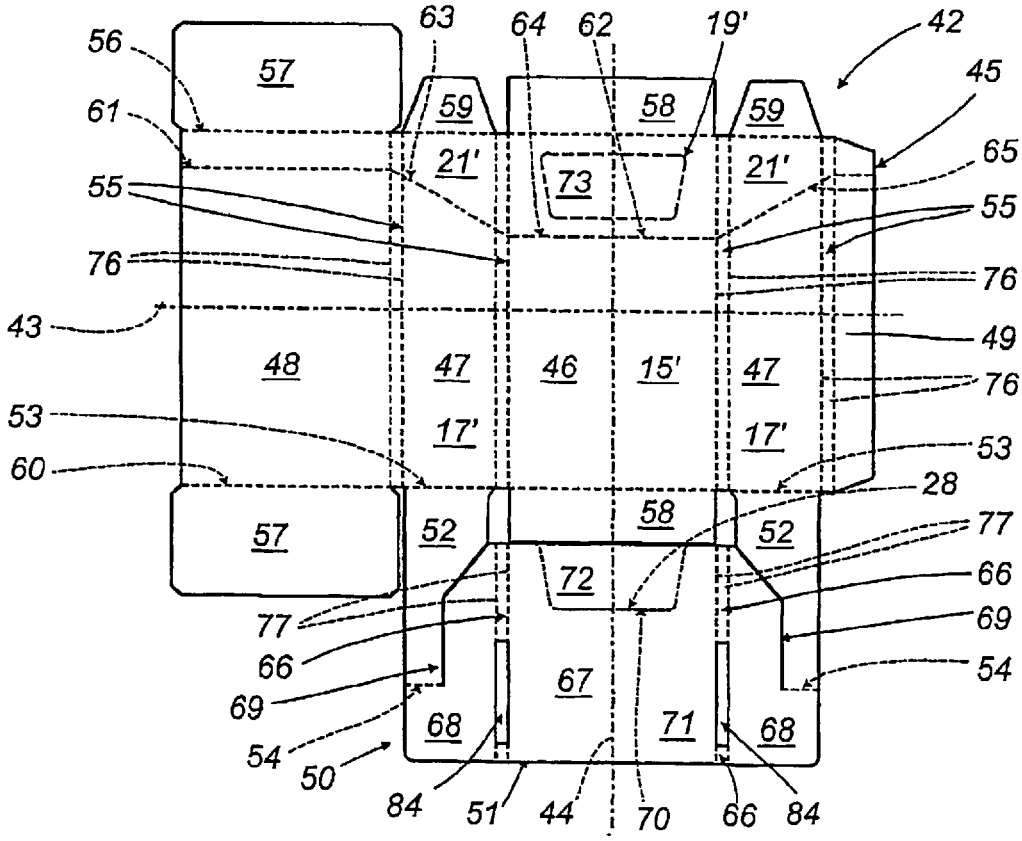

Referring to FIG. 2, the blank 42 is used to fashion a wrapper 1 as illustrated in FIG. 10 and the precreased bend areas 55 consist each in two crease lines 74 extending mutually parallel and separated one from the other by a first predetermined distance, generating bevelled corner edges 36 on the erected wrapper 1. Similarly, the second precreased bend areas 66 consist each in two crease lines 77 generating a frame 23 with bevelled corner edges when the wrapper is erected.

Figure 3:
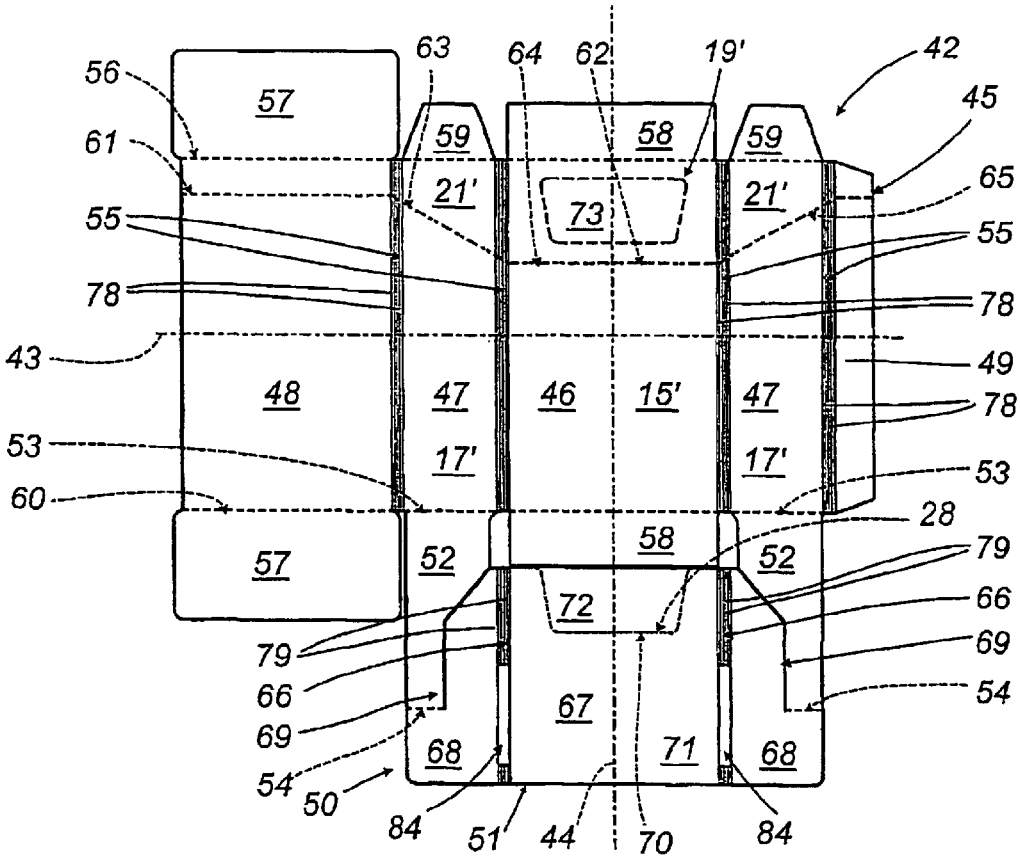

Referring to FIG. 3, the blank 42 is used to fashion a wrapper 1 as illustrated in FIG. 11 and the precreased bend areas 55 consist each in a plurality of crease lines 78 extending mutually parallel and separated one from the other by a second predetermined distance, generating rounded corner edges 37 on the erected wrapper 1. Similarly, the second precreased bend areas 66 consist each in a plurality of crease lines 79 generating a frame 23 with rounded corner edges when the wrapper is erected.

Figure 4:
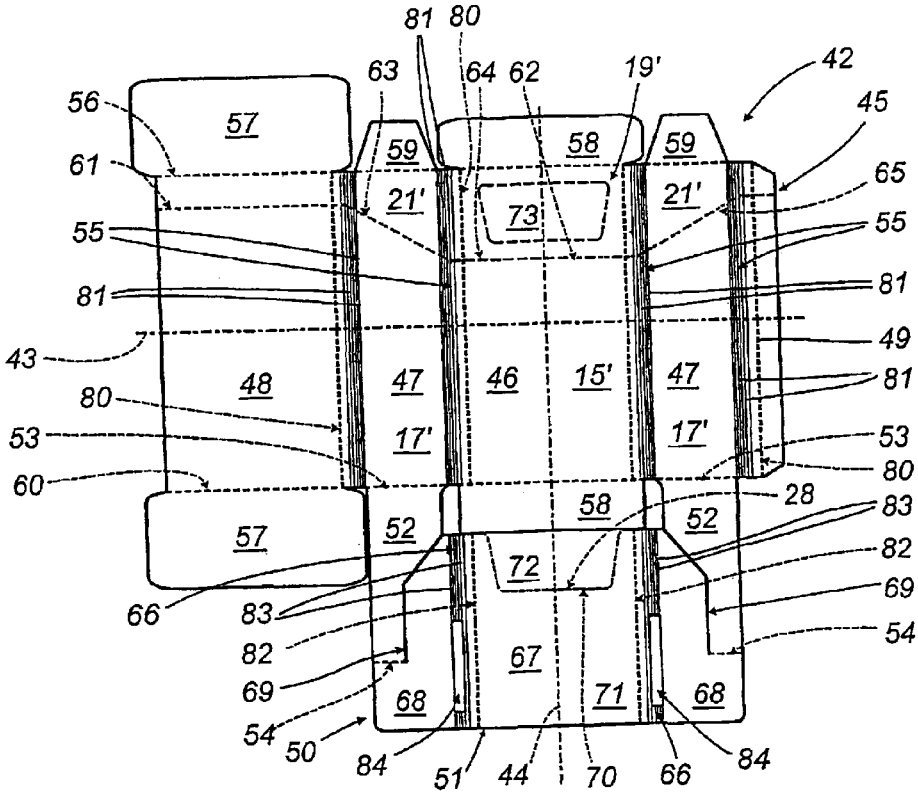

Referring to FIG. 4, each of the precreased bend areas 55 comprises a crease line 80 generating the sharp corner edge 41 of the wrapper 1 illustrated in FIG. 12, also a plurality of crease lines 81 extending mutually parallel and serving to connect a central part 38' of the lateral panel 47 to the crease line 80. Each set of lines 80 and 81 makes up one longitudinal lateral band 39 of the wrapper 1 illustrated in FIG. 12. Similarly, the second precreased bend areas 66 consist each in a single crease line 82 and a plurality of crease lines 83 generating a frame 23 bordered by lateral bands 39 when the wrapper is erected.

In the examples of FIGS. 1 to 4, the first portion 51 is hinged along the second precreased fold lines 54 to the connecting arms 52, which in turn are hinged along the first precreased fold lines 53 to the ends of the portions 17' of the lateral panels 47 destined to become the flanks 17 of the container 11, and in this instance the U-profiled edge 28 of the first portion 51 incorporating the frame 23 is disposed with the cutaway directed toward the main portion 45 of the blank 42.

In an embodiment of the blank not illustrated in the drawings, the arms 52 might be hinged along the first precreased fold lines 53 to the ends of those portions 21' of the lateral panels 47 which provide the flanks 21 of the lid 13, and in this instance the U-profiled edge 28 of the first portion 51 incorporating the frame 23 would be disposed with the cutaway directed away from the main portion 45 of the blank 42.

Observing the blanks 42 illustrated in FIGS. 1 to 4, it will be seen that the second precreased bend areas 66 of the appendage 50 are broken by slots 84 of predetermined length designed to enable faultless positioning of the frame in relation to the wrapper, avoiding deformations along the sharp corner edges 10 of FIG. 9, along the bevelled corners edges 36 of FIG. 10, along the rounded corner edges 37 of FIG. 11, and similarly along the lateral bands 39 of FIG. 12. The slots 84 are also instrumental in allowing the appendage 50 to be bent more accurately along the selfsame areas 66.

Referring now to FIGS. 5 to 8, it is assumed that the blank 42 described thus far lies flat initially with the unfinished side uppermost, the opposite side being that with the treated surfaces that will constitute the part of the wrapper 1 exposed to view.

To ensure that the frame 23, when brought into the assembly position over the main portion 45 of the blank 42, will be disposed with its treated surface offered to the untreated surface of the wrapper 1, the procedure according to the lo invention includes a sequence of folding steps conceived in such a way that the central cutaway 29, the restraints 30 and the top ends 32 of the lateral portions 31 of the frame 23 will be disposed ultimately with the treated surface facing outwards.

Figure 5:
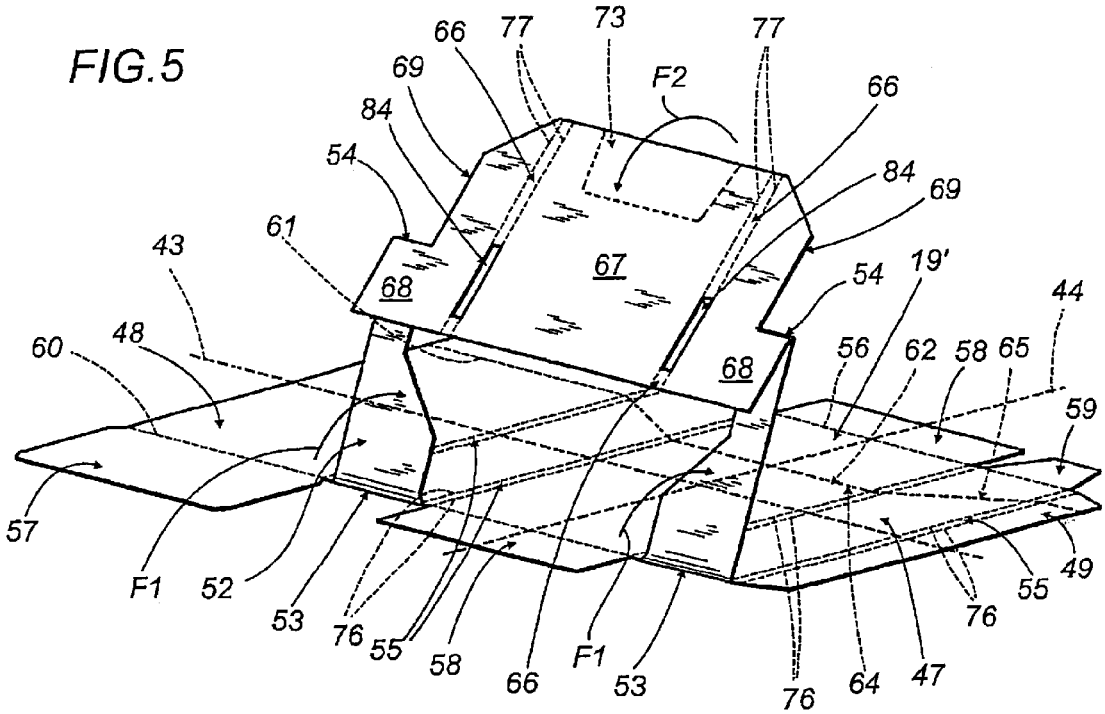
FIGS. 5 to 8 illustrate the blank of FIG. 2, viewed schematically and in perspective, in a number of folding steps effected in manufacturing the wrapper of FIG. 10.

The folding steps in question involve rotating the connecting arms 52 about the respective first precreased fold lines 53 in a clockwise direction, as viewed in FIG. 5 and indicated by the arrows denoted F1, to the point of engaging in full frontal contact with the main portion 45 of the blank 42, and more exactly with the lateral panels 47.

Figure 6:
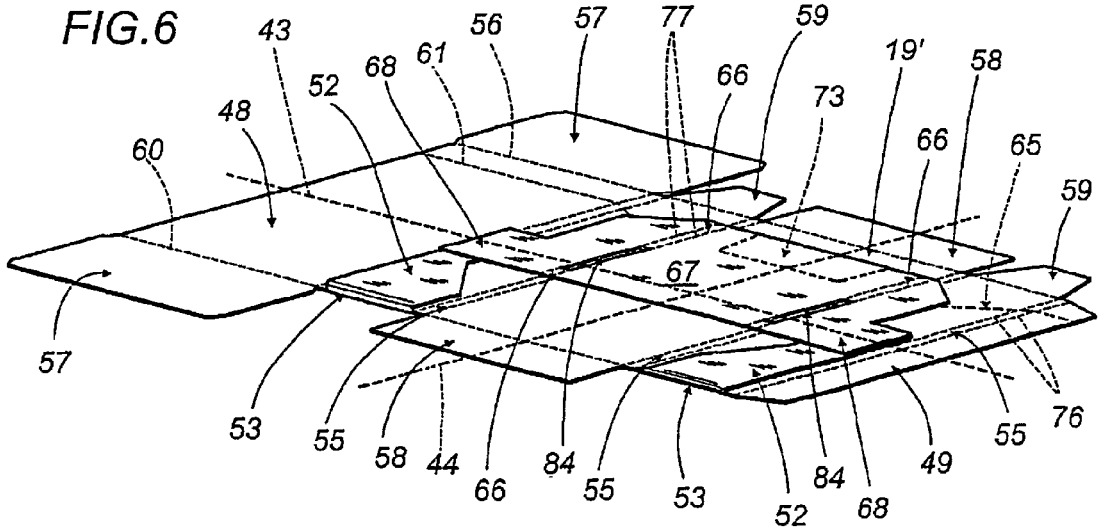

As the arms 52 are being thus rotated, the first portion 51 of the appendage 50 incorporating the frame 23 is rotated about the second precreased fold lines 54 in an anticlockwise direction, as viewed in FIG. 5 and indicated by the arrow denoted F2, in such a way as to bring the treated face of the first portion 51 into contact with the untreated face of the main portion 45 of the blank 42, as illustrated in FIG. 6. In this position, the cutout 73 enters into contact with a layer of adhesive material and is made to stick fast to the corresponding portion 19' of the central panel 46, thus remaining attached to the lid 13 when the wrapper 1 is broken open.

Figure 7:
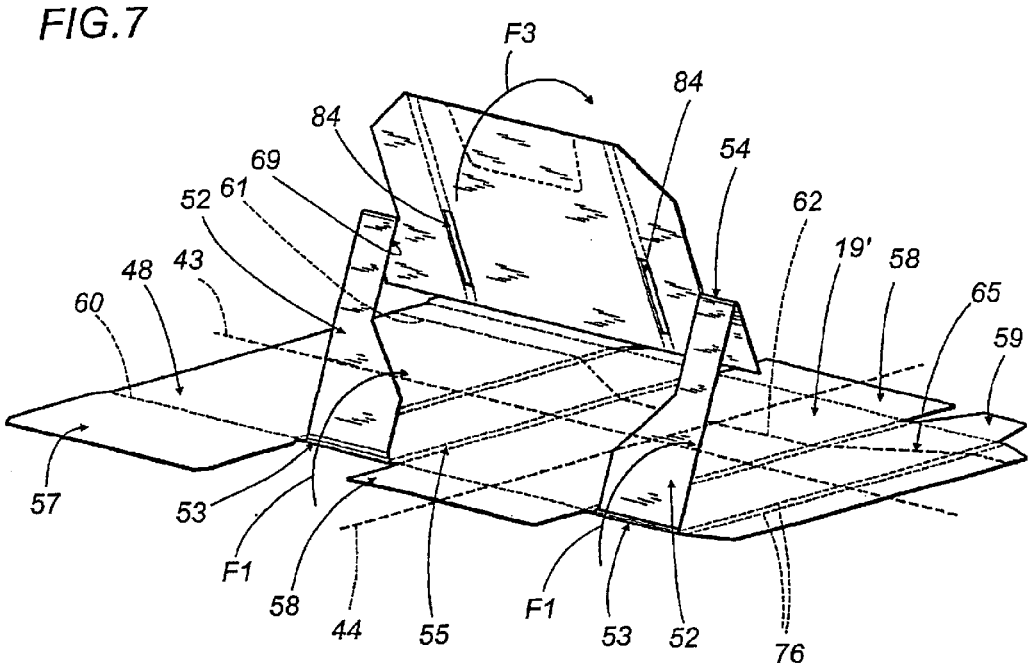

In the example of FIG. 7, which illustrates an alternative solution, the first portion 51 of the appendage 50 incorporating the frame 23 is rotated clockwise about the second precreased fold lines 54, as indicated by the arrow denoted F3, in the same direction as that in which the arms 52 are rotated, indicated by the arrows denoted F1.

Figure 8:
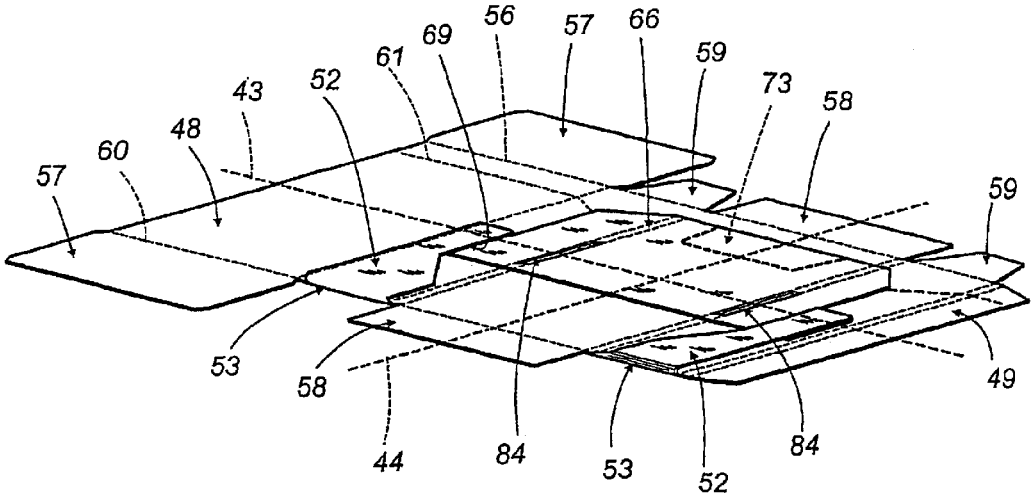

It will be observed that in the example of FIG. 5 the arms 52 assume a position of direct contact with the lateral panels 47, as discernible in FIG. 6, whereas in the example of FIGS. 7 and 8, part of the lateral portions 68 will be interposed between the arms 52 and the lateral panels 47.

In both of the examples described, the orientation of the U-profiled edge 28 defined by the perforation line 70 remains the same both before assembly, as illustrated in FIGS. 1 to 4, and following assembly as illustrated in FIGS. 6 and 8.

Finally, it will be evident in the light of the foregoing that the flat diecut blank 42 might be embodied with the principal panels 46, 47 and 48 arranged in a manner other than that described and illustrated, and/or with a different arrangement of the frame or first portion 51 relative to the selfsame panels 46, 47 and 48.

In particular, and by way of example, the first portion 51 might be connected by way of at least one arm 52, and preferably one only, to a side edge of the lateral panel 47 or the end panel 48, and the end flap 49 might be associated with this same panel 48. In this instance, rotating the arm 52 about the crease line along which it is joined to the panel 47 or 48 would bring the first portion 51 into contact first with the main body of the blank 42, whereupon a further rotation in the opposite direction about the crease line along which the first portion 51 is joined to the arm 52 would bring the first portion 51 into its final position of contact with the central panel 46.

Alternatively, moreover, the flat diecut blank 42 could extend along a longitudinal axis only, in which case the first portion 51 constituting the frame would be connected by way of two arms 52 to an end portion of the blank 42.

What is claimed is:

1. A blank for a wrapper of rigid type with a hinged lid for tobacco products, the wrapper (1) appearing substantially parallelepiped in shape, presenting a front face (5), a rear face (6), two flank faces (7), a top end face (8) and a bottom end face (9), and comprising a container (11) and a lid (13) joined together along a hinge line (14), also a frame (23) with a U-profiled top edge (28), the blank (42) presenting a transverse axis (43) and a longitudinal axis (44) and comprising a main portion (45) destined to form the container (11) and the lid (13), and an appendage (50) destined to form the frame (23), characterized in that the main portion (45) destined to form the container (11) and the lid (13) of the wrapper (1), extends along said transverse axis (43), and the appendage (50) destined to form the frame (23) extends, with respect to the main portion (45) of the blank (42) destined to form the lid (13), the front face (5) and the two flank faces (7), along said longitudinal axis (44); said appendage (50) extending at opposite side of a central panel (46), defining also the front face (5) of the wrapper (1), with respect to the portion defining the lid (13); said appendage (50) presents a first portion (51) comprising the frame (23) and at least one connecting arm (52) terminating at the opposite ends in first and second precreased fold lines (53, 54) along which the selfsame arm (52) is joined respectively to the main portion (45) and to the first portion (51) comprising the frame (23).

2. A blank as in claim 1, wherein the appendage (50) presents two connecting arms (52) disposed one on either side of the first portion (51), terminating at the opposite ends in respective first precreased fold lines (53) aligned one with another, and respective second precreased fold lines (54) aligned one with another and extending parallel to the first precreased fold lines (53).

3. A blank as in claim 2, wherein the main portion (45) is aligned on the transverse axis (43) and the first and second precreased fold lines (53, 54) extend parallel with the selfsame transverse axis (43).

4. A blank as in claim 1, wherein the first portion (51) comprising the frame (23) is disposed with the U-profiled top edge (28) facing in the same direction as that assumed ultimately when the first portion (51) is united with the main portion (45) destined to provide the container (11) and the lid (13) of the wrapper (1).

5. A blank as in claim 1, wherein the main portion (45) comprises, aligned along the transverse axis (43) and joined one to another by respective first longitudinal precreased bend areas (55), a central panel (46) and two lateral panels (47) adjacent to the central panel (46), presenting respective portions (15', 17') destined to provide the front (15) and the flanks (17) of the container (11) and respective portions (19', 21') destined to provide the front (19) and the flanks (21) of the lid (13); the arms (52) are hinged along the first precreased fold lines (53) to the ends of the portions (17') of the lateral panels (47) destined to provide the flanks (17) of the container (11); and the U-profiled edge (28) of the first portion (51) comprising the frame (23) is disposed with the U profile directed toward the main portion (45).

6. A blank as in claim 1, wherein the main portion (45) comprises, aligned along the transverse axis (43) and joined one to another by respective first longitudinal precreased bend areas (55), a central panel (46) and two lateral panels (47) adjacent to the central panel (46), presenting respective portions (15', 17') destined to provide the front (15) and the flanks (17) of the container (11) and respective portions (19', 21') destined to provide the front (19) and the flanks (21) of the lid (13), the arms (52) are hinged along the first precreased fold lines (53) to the ends of the portions (21') of the lateral panels (47) destined to provide the flanks (21) of the lid (13), and the U-profiled edge (28) of the first portion (51) comprising the frame (23) is disposed with the U profile directed away from the main portion (45).

7. A blank as in claim 1, wherein the appendage (50) destined to provide the frame (23) comprises, joined one to another by respective second longitudinal precreased bend areas (66), a central portion (67) and two lateral portions (68) aligned on the connecting arms (52), joined to the selfsame arms (52) along the second precreased fold lines (54) and destined to provide the flanks of the frame (23), of which the central portion (67) is divided by a perforation line (70), coinciding with the U-profiled edge (28), into a first area (71) constituting the breast piece of the frame (23) and a second area (72) providing a cutout (73) that will be applied to the inside of the portion (19') of the central panel (46) coinciding with the front (19) of the lid (13).

8. A blank as in claim 7, wherein the first and second precreased bend areas (55, 66) comprise at least one crease line (74, 75).

9. A blank as in claim 7, wherein the first and second precreased bend areas (55, 66) comprise two crease lines (76, 77) separated one from another by a predetermined distance.

10. A blank as in claim 1, wherein the second precreased bend areas of the appendage are broken by slots of predetermined length.

11. A blank as in claim 7, wherein at least one of the first and second precreased bend areas (55, 66) comprises a plurality of crease lines (78, 79) extending mutually parallel and separated one from another by a predetermined distance.

12. A blank as in claim 7, wherein at least one of the first and second precreased bend areas (55, 66) comprises a crease line (80, 82) positioned on at least one of the central and lateral panels (46, 47) and on at least one of the lateral portions (68) of the appendage (50) in such a way as to define a central part and a part rendered pliable by longitudinal crease lines (81, 83).

13. A blank as in claim 1, from which to fashion a carton designed to contain a plurality of packets of cigarettes.

14. A blank as in claim 1, from which to fashion a packet of cigarettes.

15. A procedure for manufacturing a wrapper of rigid type with a hinged lid for tobacco products, wherein the wrapper (1) is obtained from a flat diecut blank (42) presenting a transverse axis (43), a longitudinal axis (44), a treated face and an untreated face, and comprising a main portion (45) destined to form the container (11) and the lid (13) and an appendage (50) destined to form a frame (23), characterized in that the main portion (45) destined to form the container (11) and the lid (13) of the wrapper (1), extends along said transverse axis (43), and the appendage (50) destined to form the frame (23) extends, with respect to the main portion (45) of the blank (42) destined to form the lid (13), the front face (5) and the two flank faces (7), along said longitudinal axis (44); said appendage (50) extending at opposite side of a central panel (46), defining also the front face (5) of the wrapper (1), with respect to the portion defining the lid (13); said appendage (50) presenting a first portion (51) comprising the frame (23) and at least one connecting arm (52) terminating at the opposite ends in first and a second precreased fold lines (53, 54) along which the selfsame arm is joined respectively to the main portion (45) and to the first portion (51) comprising the frame (23), and in that it comprises the steps of rotating the arm (52) about the first precreased fold line (53) to the point at which it is bent double over the main portion (45), and rotating the first portion (51) of the appendage (50) comprising the frame (23) about the second precreased fold line (54) to the point at which the treated face of the selfsame first portion (51) is bent double over the untreated face of the central panel (46) of the main portion (45) defining the front face (5) and the lid (13) of the wrapper.

16. A procedure as in claim 15, wherein the step of rotating the first portion (51) of the appendage (50) comprising the frame (23) about the second precreased fold line (54) takes place during the step of rotating the arm (52) about the first precreased fold line (53).

17. A procedure as in claim 15, wherein the appendage (50) presents two connecting arms (52) disposed one on either side of the first portion (51), terminating in respective first precreased fold lines (53) aligned one with another, and respective second precreased fold lines (54) aligned one with another and extending parallel to the first precreased fold lines (53), comprising the steps of rotating the arms (52) about the respective first precreased fold line (53) to the point at which they are bent double over the main portion (45), and simultaneously rotating the first portion (51) of the appendage (50) comprising the frame (23) about the respective second precreased fold lines (54) to the point at which the treated face of the first portion (51) is bent double over the untreated face of the main portion (45).

18. A procedure as in claim 15, wherein the first portion (51) of the appendage (50) comprising the frame (23) is rotated about the second precreased fold line (54) in the opposite direction to that in which the arms (52) are rotated.

19. A procedure as in claim 15, wherein the first portion (51) of the appendage (50) comprising the frame (23) is rotated about the second precreased fold line (54) in the same direction as that in which the arms (52) are rotated.

* * * * *